United States Patent [19]

Fackler

[11] 4,220,090

[45] Sep. 2, 1980

[54] SHOT WAD COLUMN

[76] Inventor: David G. Fackler, 16230 Fifth Ave. North, Minneapolis, Minn. 55391

[21] Appl. No.: 939,451

[22] Filed: Sep. 5, 1978

[51] Int. Cl.[3] ..... F42B 7/08

[52] U.S. Cl. ..... 102/42 C; 102/95

[58] Field of Search ..... 102/42 C, 42 R, 95

[56] References Cited

U.S. PATENT DOCUMENTS

| | | | |
|---|---|---|---|
| 3,285,174 | 11/1966 | Moehlman et al. | 102/42 C |
| 3,402,664 | 9/1968 | Cramer | 102/42 C |
| 3,444,777 | 5/1969 | Lage | 102/42 C |
| 3,623,431 | 11/1971 | Hendricks | 102/42 C |
| 3,670,650 | 6/1972 | McCaffrey | 102/42 C |

*Primary Examiner*—Harold J. Tudor

*Attorney, Agent, or Firm*—Peterson, Palmatier, Sturm & Sjoquist

[57] ABSTRACT

A shot wad column for use in a shotshell in a shotgun to accommodate a shot charge such as steel shot or lead shot, and including a gas seal snapped in engagement to a shot cup having a fluted exterior diverging peripheral wall. The shot cup and gas seal snap together to form the shot wad column. The shot cup of the shot wad column is of a low or high density material such as polyethylene to accept lead or steel shot respectively while the gas seal is of a low density material such as polyethylene to easily rupture or part under high or excessive pressures which vent up and through the fluted portion of the outside peripheral wall of the shot cup. The fluted exterior diverging peripheral wall contains a plurality of alternating lands and valleys which traverse the longitudinal length of the shot wad allowing for the venting of high pressure gases which can escape following the rupture of the gas seal and further allowing the valleys to extend outward but not touch the sides of the barrel of the shotgun to allow for repositioning of the shot charge. The lands and valleys also provide flexing of the sidewalls of the shot cup which reduces the sidewall pressures at specific pressure points and distributes the pressure over a large area of the shot cup. The lands and valleys are strong enough to withstand the scrubbing effect while traveling down the barrel of the shotgun.

8 Claims, 8 Drawing Figures

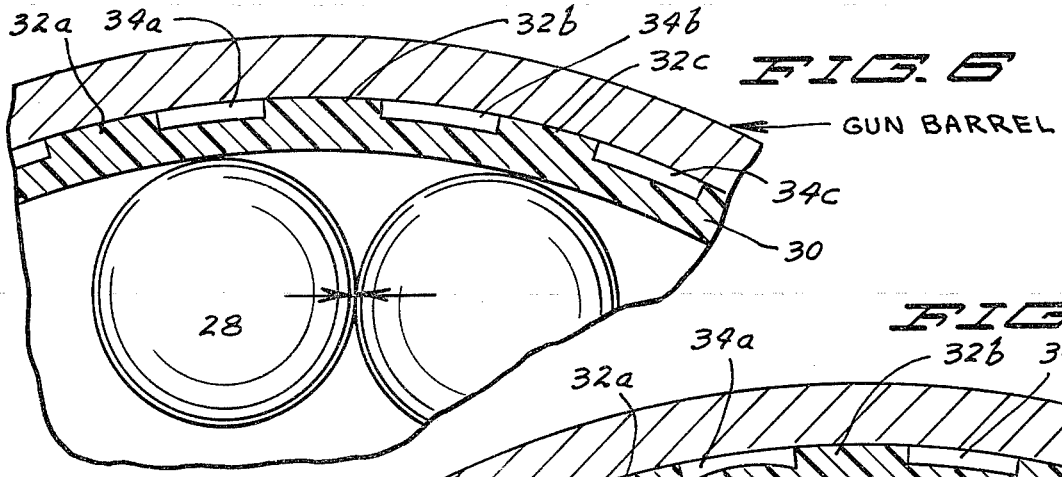
FIG. 6
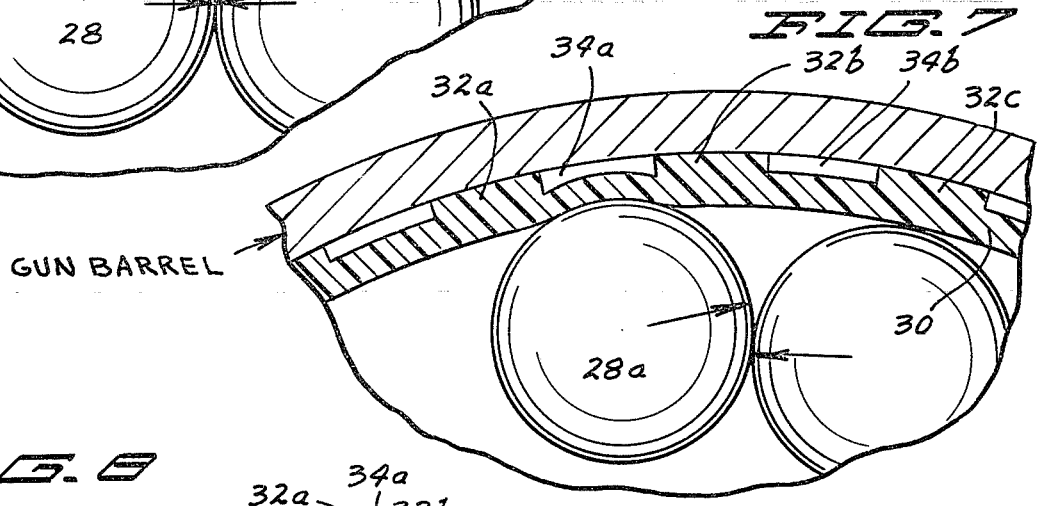
FIG. 7
FIG. 8
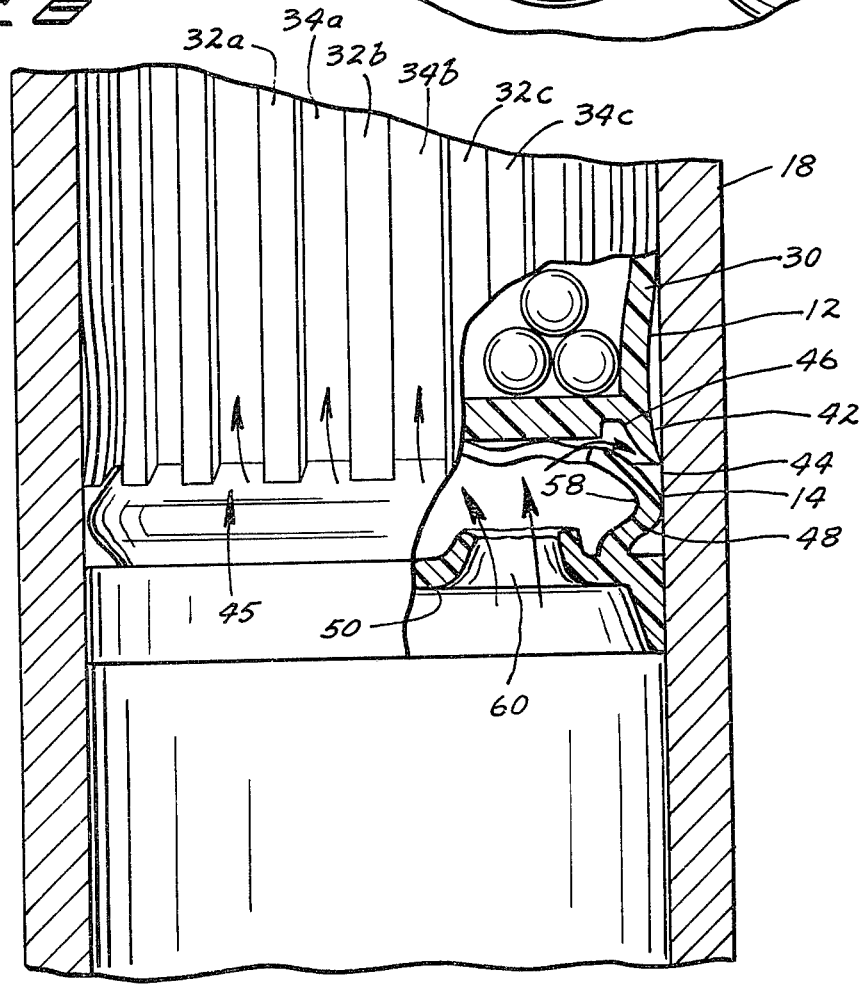

SHOT WAD COLUMN

BACKGROUND OF THE INVENTION

1. Field of the Invention

The present invention relates generally to shotshells, and more particularly, pertains to a shot wad column for utilization within a shotshell.

2. Description of the Prior Art

In the field of shotshells, it has been a general practice to utilize one piece wads, some of which have lands and valleys which do and do not longitudinally extend the entire length of the wad.

The prior art one piece wads have been unsatisfactory in that the gas seal is a fixed portion of the wad thereby denying a safety feature of the gas seal rupturing at high pressures and permitting excess pressures to escape and vent up the sides of the wad. Some of the wads have wad crush sections which crush too easily and do not provide for the prior combustion of slower burning powders. The prior art wads which have a plurality of lands and valleys are not acceptable as the lands and valleys do not extend the longitudinal length of the wad thereby not permitting substantial escape of the excessive gases and extreme pressures. The lands and valleys in the prior art wads which traverse the longitudinal length of the wad are too shallow to provide flexing capabilities of the wad with respect to the shotshell sidewall and to act as a substantial escape route for extreme high pressures and extreme high gases.

The prior art wads failed to provide a proper ratio of the height and distance of the lands and valleys of the side of the shot cup. The valleys of the prior art wads expanded outward and touched the sides of the shotshell and the barrel of the gun when the shot charge repositioned within the wad, and flexed the valley between the lands outwards resulting in the surface of the valley scrubbing on the bore. Other prior art wads provided too many lands and valleys, and as a consequence, the valleys would not allow for reasonable expansion and flexing during firing of a powder charge in the shotshell. In actuality, too many lands and valleys provided a rigid support to the shot cup. Also, the lands and valleys are not strong enough to withstand the scrubbing effect while traveling the length of the barrel of the gun or even be capable of traveling the length of the barrel of the gun. Finally, the prior art wads trapped the generated gas pressure and did not provide for quick release of the wad from the shotshell.

The present invention overcomes the shortcomings of the prior art wads by providing a shot wad column including a gas seal snapped into engagement with a shot cup having a flutted exterior diversing peripheral wall.

SUMMARY OF THE INVENTION

The general purpose of this invention is to provide a shot wad column for use in a shotshell including a shot cup having a fluted exterior diverging peripheral wall and a gas seal which snaps into engagement with the bottom end of the shot cup.

According to a preferred embodiment of the present invention, there is provided a shot wad column including a shot cup having a flutted exterior diverging peripheral wall and an integral bottom wall, and a gas seal having an upwardly extending peripheral crown and an integral bottom wall, the bottom wall including a tapered end whereby the crown of the gas seal engages against the integral bottom of the shot cup whereby the diverging peripheral wall of the shot cup provides for cushioning of pressures generated by the shot charge, and the flutted exterior provides for flexing of the shot cup and for venting high or extreme pressure gases on rupturing or parting of the gas seal.

One significant aspect and feature of the present invention is a shot cup suitable for use with steel shot which prevents barrel damage to the shotgun. The shot cup is molded from a material of high density polyethylene. The flutted exterior diverging peripheral wall of the shot cup provides barrel protection not before available with other shot cups.

Another significant aspect and feature of the present invention is a shot wad column which provides an inherent safety feature of a gas seal which ruptures or parts under high or extreme gas pressures. The gas seal is molded from a material of low density polyethylene and suitable for use with shot cups of either low or high density material.

Having briefly described one preferred embodiment of the present invention, it is a principal object hereof to provide a shot wad column including a gas seal engaged with a shot cup.

An object of the present invention is to provide a shot wad column which provides maximum safety in having a gas seal of low density material which ruptures under extreme high gases or extreme high pressures and venting the extreme high gases or extreme high pressures through the ruptured gas seal up through the flutted exterior diverging peripheral wall of the shot cup. The gas seal is particularly useful in the hunting type load as well as the target type of wad load.

Another object of the present invention is to provide a shot cup including a flutted exterior tapering peripheral wall having a plurality of alternating lands and valleys transversely extending the longitudinal length of the shot cup and tapering to an edge below an integral base of the shot cup where the lands and valleys reduce barrel friction by the shot cup in contact with the barrel. The valleys also provide sideways adjustment for the shot charge. The lands and valleys are thick enough and wide enough respectively to allow slight bowing of the valleys, but yet not enough elasticity of the valleys to allow contact with the barrel.

A further object of the present invention is to provide a gas seal which is interchangeable for utilization with any shot cup. The only requirement is for the shot cup to accept the gas seal in engagement.

An additional object of the present invention is to provide a shot cup having a narrow base to provide for the expansion during firing of the powder charge. The narrowness of the exterior diverging peripheral wall resists deforming of the shot cup during firing and movement allowing higher velocity and less chamber pressure.

BRIEF DESCRIPTION OF THE DRAWINGS

Other objects and many of the attendant advantages of this invention will be readily appreciated as the same becomes better understood by reference to the following detailed description when considered in connection with the accompanying drawing, in which like reference numerals designate like parts throughout the figures thereof and wherein:

FIG. 6 illustrates a section of a top view of the shot cup loaded with shot charge;

FIG. 7 illustrates a section of a top view of the shot cup loaded with shot charge during powder ignition; and, FIG. 8 illustrates a vertical cross section of the shot cup and gas seal during rupture and part through of the gas seal.

DESCRIPTION OF EMBODIMENTS

Figure 1:
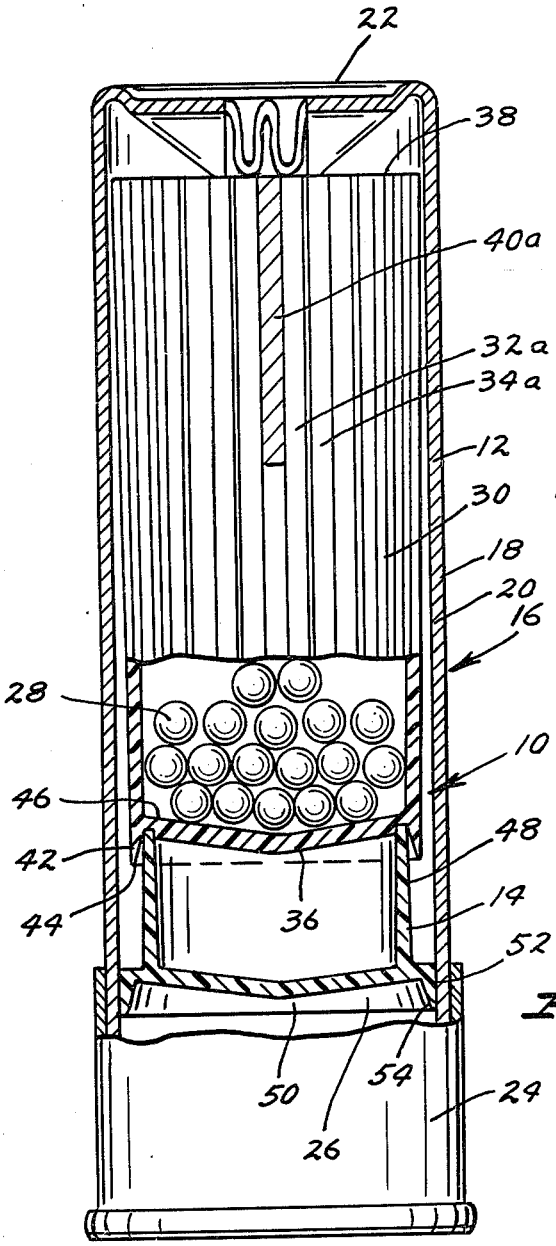
FIG. 1 illustrates a side view, partly in exposed vertical cross section of the present invention, a shot wad column including a shot cup and a gas seal.

FIG. 1, which illustrates a side view, partly exposed vertical cross section of the present invention, shows a shot wad column 10 including a shot cup 12 and a gas seal 14 in a shotshell 16 for use in a shotgun. The shotshell includes a shotshell case 18 having a tubular wall 20, a front end portion 22 which is crimped over to close the interior of shotshell 16, and a metal base cup 24 carries a primer which is not illustrated in the figure. A powder charge 26 is confined in the base portion of the interior of the shotshell 16 case and a shot charge 28 is provided in the shot cup 12. The shot cup 12 can accommodate either steel or lead shot.

Figure 2:
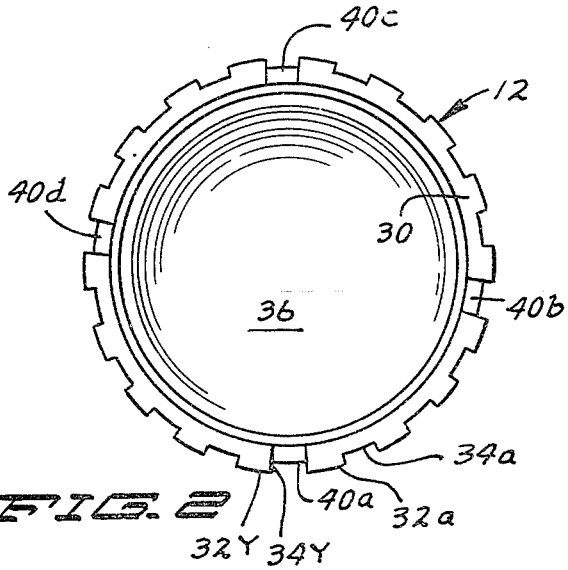
FIG. 2 illustrates a top view of the shot cup.
Figure 3:
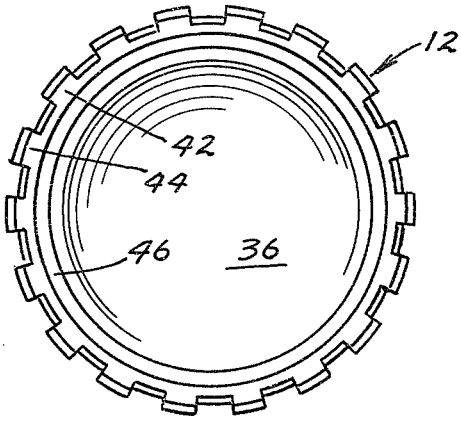
FIG. 3 illustrates a bottom view of the shot cup.

The shot cup 12 of the present invention relates to the shot wad column 10 for the shotshell 16, and is preferably molded of a hard and resilient plastic such as high or low density polyethylene, and is formed in one integral piece. While high density polyethylene has been disclosed by way of example and for purposes of illustration only, material other than plastics can be utilized with similar or other desirable characteristics. An exterior peripheral sidewall 30 of the shot cup 12, having a plurality of alternating lands 32*a*–32*r* and valleys 34*a*–34*r*, as also illustrated in FIGS. 2 and 3, is formed integrally and in one piece to a bottom wall 36. "Lands and valleys" is not to be construed as an encompassing phrase and can also include phrases such as "ribs and grooves", "flutted", "railed", etc. The peripheral sidewall 30 has a diverging outward taper from the bottom wall 36 to an open mouth 38 of the peripheral sidewall 30 so that the outer circumferential diameter of the open mouth 38 of the exterior peripheral sidewall 30 coincides with the interior diameter of the shotshell 16. The amount of diverging taper is such that the bottom of the shot cup is of a narrower diameter with respect to the top of the shot cup at the open mouth to allow for expansion of the bottom portion of the shot cup during firing of the shotshell as later discussed. A plurality of longitudinally transversely extending slits 40*a*–40*d*, by way of example and for purposes of illustration only, are provided in the peripheral sidewall 30 extending from the open mouth 38 half way towards the bottom wall 36 to allow the forward portions of the peripheral sidewall 30 to flex outwardly after the shot charge 28 is propelled forwardly of the barrel of the shotgun. The bottom wall 36 is dome-shaped with the concave side of the bottom wall forming the open end mouth 38 of the peripheral sidewall 30. Specifically, the dome-shaped bottom wall 36 is substantially cone-shaped and has a slightly rounded apex. While the thickness of the bottom wall is of the same order of magnitude as the thickness of the peripheral sidewall 30, the bottom wall 36 is slightly thicker than the thickest portion of the peripheral sidewall 36 at the outer peripheral portion of the bottom wall 36. The bottom wall 36 joins the peripheral cup wall 30 at an obliquely angular relation. Immediately adjacent the bottom wall 36, the rear lower end or bottom flange 42 of the peripheral sidewall 30 extends past and below the bottom wall 36 and tapers sharply to a thin edge 44, forming castellations 45 as illustrated in FIG. 8. An inner recessed groove 46 surrounds the exterior circumference diameter of the bottom wall 36, and protrudes slightly into the peripheral sidewall 30 and adjacent to the interior diameter of the rear lower end 42 at the tapered thin edge 44.

The gas seal 14 of the present invention relates to the shot wad column 10 for the shotshell 16 and is preferably molded of a soft and resilient plastic such as low density polyethylene, and is formed in one integral piece. While low density polyethylene has been disclosed by way of example and for the purposes of illustration only, material other than plastics can be utilized in the similar or other desirable characteristics. The gas seal 14 includes an upwardly extending crown 48 formed integrally with a bottom wall 50 and surrounded by a ring 52 which tapers to a thin edge 54. The bottom wall 50 is dome-shaped with the concave side of bottom wall 50 facing open end mouth 56 of the crown 48. More specifically, the dome-shaped bottom wall 50 is substantially cone-shaped and has a slightly rounded apex. While the thickness of the bottom wall 50 is of the same order of magnitude as the thickness of the crown 48, the thickness of the bottom wall 50 is slightly thicker than the thickness of the crown 48. At the outer peripheral portion of the bottom wall 50, the bottom wall 50 joins the crown 48 at an obliquely angular relation.

FIG. 2, which illustrates a top view of the shot cup 12, shows the plurality of alternating lands and valleys 32*a*–32*r* and 34*a*–34*r*, respectively, surrounding the peripheral sidewall 30, the slits 40*a*–40*d*, and the integral bottom wall 36.

FIG. 3, which illustrates a bottom view of the shot cup 12, shows the bottom wall 36, the inner groove 46, and the thin tapered edges 44 of the lands and valleys of the rear lower end 42.

Figure 4:
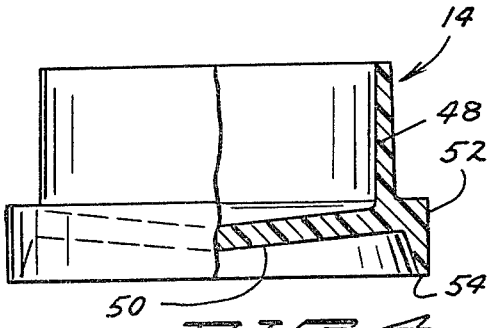
FIG. 4 illustrates a side view, partly in exposed vertical cross section of the gas seal.

FIG. 4, which illustrates a side view, partly in exposed vertical cross section, shows the gas seal 14, the crown 48, the bottom wall 50, the ring 52, and the thin tapered edge 54.

Figure 5:
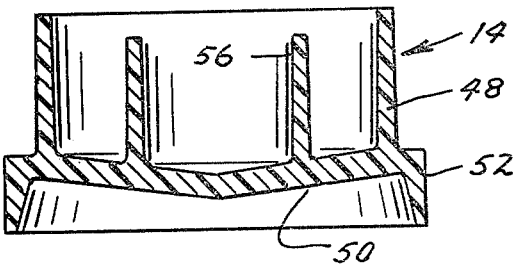
FIG. 5 illustrates a vertical cross sectional view of another embodiment of the gas seal.

FIG. 5, which illustrates a vertical cross sectional view of another embodiment of the gas seal 14, shows the gas seal 14, the crown 48, the bottom wall 50, the ring 52, and the thin tapered edge 54. An intervening crown 56 extends upwardly from the bottom wall 50 to a height to engage with the bottom wall 36 of a shot cup 12 when the crown 48 is accepted by the inner recessed groove 46.

MODE OF OPERATION

The shot column wad 10 of the present invention is particularly useful in larger types of shotshells, particularly such as in the 12 gauge shotgun shotshells having a 2¾ and 3 inch 12 gauge hull.

When the shotshell 16 employing the shot wad column 10 of the present invention is loaded into a shotgun and fired, the ignition of the powder charge 26 creates very significant gas pressure in the shotshell case 18 and the barrel, and produces extremely rapid acceleration of the shot wad column 10 containing the shot charge 28 toward the muzzle of the barrel. As the pressures suddenly build up and acceleration of the shot wad column 10 and shot charge 28 increases, the reaction in the shot charge 28 causes considerable pressure between the individual shot in the shot charge 28 and also causes the shot to bear with very significant force against the peripheral cup wall 30 of the shot cup 12 causing resistance to movement and a rise in chamber pressure. Accompanying the rapid buildup of pressure between adjacent shot in the shot charge 28 is a substantial increase in temperature in the shot as well.

FIG. 6 illustrates a horizontal section of the shot charge 28 loaded in the shot cup 12 of the shotshell case 18 at a rest position prior to ignition and firing of the powder charge 26, and aligned around the interior of the peripheral wall 30 of the shot cup 12.

FIG. 7 illustrates a horizontal sectional view of the movement of the shot charge 28 during pressure between the individual shot in the shot charge 28. Considerable flexing of the shot cup 12 occurs and the narrowing tapering towards the bottom wall 36 of the shot cup 12 allows for expansion of the lower portion of the shot cup 12, resistance to deformation of the shot cup 12 during firing, and movement within the shot cup 12 allowing for higher velocity and lower chamber pressure. The flexing of the deep ribbed exterior surface of the lands and valleys 32 and 34 respectively at the peripheral sidewall 30 allows for flexing movement of the peripheral side of wall 30 of the shot cup 12 against the inside of the barrel of the shotgun which is very important, especially with steel shot charges. Specifically, the figure illustrates the flexing of the valley 34*a* by a shot charge pellet 28*a* and corresponding movement between the arrows respectively. The lands and valleys 32 and 34 on the exterior of the peripheral wall 30 reduces surface area of the shot cup 12 in contact against the barrel of the shotgun and provides for a greater velocity of the shot charge at a minimum chamber pressure. Steel shot charges have none of the yielding qualities of lead shot; therefore, the flexing movement of the shot cup 12 imparts to the steel shot charge a higher degree of controlling the hardness factor thereby providing a higher velocity to the steel shot and lessening any possibility of barrel damage. Also, the valleys between the lands provides for venting of excess gas pressure to escape around the shot cup before the shot cup has traveled the length of the barrel.

FIG. 7 further illustrates the jostling and repositioning of the shot charge 28, especially where the valleys 34 are flexing outward at the pressure points where the shot presses against the peripheral sidewall 30 of the shot cup 12. The valleys 34 also provide for sideway adjustment and cushioning of the shot charge 28. This overall yielding re-orientation movement relieves pressures exerted by the shot charge 28 against the lands. The width of the lands and valleys 32 and 34 respectively and the depth of the valleys 34 is determined to provide flexing of the peripheral sidewall 30 of the shot cup 12, and is also proportional to the shot size resulting in contact support points inside the shot cup 12 which allows slight bowing of the valleys but yet not enough elasticity to allow conformity of the valleys 34 with the barrel of the shotgun. The width of each of the valleys 34 is determined to be the same order of magnitude as the diameter of a shot of the shot charge 28 such as No. 2 Buckshot having a diameter of 0.270 inches for deer loads to No. 7 American sized shot having a diameter of 0.10 inches for geese loads, not less than 20 percent of the average sized pellets of the shot charge 28. The width of the lands and valleys can be calculated for example to be the diameter of standard No. 6 American sized shot having a diameter of 0.110 inches. Larger sized shot will have a larger contact surface with the interior shot cup surface, and overlap a land or valley area.

The lands and valleys 32 and 34 respectively must also be large enough and strong enough to withstand the scrubbing effect while traveling down the barrel, and likewise, protect the barrel from contact with the shot charge 28 by minimizing pressure point penetration and scrubbing through by the shot charge 28. The minimum depth to protect the barrel and shot charge 28 is approximately 0.015 inches. The width of the lands should be a minimum of 0.025 inches and the valley in conjunction with the land width should be no wider than 1½ times the land width. The land width surface area should have the same contour as the barrel. The valley width should be in the range of 0.03 inches to 0.120 inches.

The shot cup 12 of the present invention for a 12 gauge shotshell has an outer diameter of 0.710 inches at the open end mouth 38 of the peripheral sidewall 30, an outer diameter of 0.695 inches at the rear lower end 42, and a height of 1.470 inches. The lands and valleys have a width of 0.620 inches respectively and the height of the valleys between each of the land and valley has a depth of 0.015 inches. The wall thickness of the peripheral sidewall 30 is 0.035 inches and the thickness of the bottom wall is 0.040 inches.

The gas seal 14 of the shot wad column 10 provides a trapped air cell cushioning section in the least amount of space directly under the shot cup 12. The trapped air cell is highly resistant to crush and provides the slower burn rated powders, especially for steel shot charges 28, a stable barrier to work against therefore providing for better combustion. The dished control portion of the bottom wall 50 of the gas seal 14 together with the dished base area of the bottom wall 36 of the shot cup 12 provides the trapped air cell and crush section of the shot wad column 10. There can be some deformation of the bottom walls 36 and 50 respectively but the walls retain the general dome-shaped configuration, although the bottom walls can vary from the original conical configuration into a more rounded dome shape to accommodate all of the pressures involved.

The gas seal 14 of the present invention for a 12 gauge shotshell has a crown diameter of 0.384 inches with a wall thickness and a height of 0.250 inches at the crown 48 for the 3 inch 12 gauge hull, an outer diameter of 0.692 inches at the tapered thin edge 54, and a height of 0.120 inches at the crown 48 for the 2¾ inch 12 gauge hull. The thickness of the bottom base 50 is 0.040 inches. The gas seal 14 can be utilized with any other shotgun components besides the shot cup 12. The gas seal 14 of the FIG. 5 illustrates another embodiment with an additional upwardly extending crown.

FIG. 8 illustrates a vertical cross section of safety features of the shot wad column 10 during rupture and part through of the gas seal 14. The cross section of the sidewall 48 of the gas seal 14 crushes and bows at 58 on account of high or excessive gas pressure and can also part, rupture, or burst through in the bottom wall 50 at 60, by way of example and for purposes of illustration under extreme pressures to release trapped gases and high pressure located behind the gas seal 14. The excessive or high gas pressures then vent up through the valleys 34 of the shot cup 12 as illustrated in the figure by the chimney effect of pressure venting of gases. This inherent and important safety feature reduces the dangers associated with shotshell loads containing excessive pressures by venting excessive gases around the shot charge 28 contained within the shot cup 12. The pressure level of allowing the gas seal to part or rupture at 60 and allow the excessive pressure to escape through the valleys 34 of the shot cup 12 is controlled by the thickness of the cross section portion of the bottom wall 50 of the gas seal 14, scoring of the bottom wall 50 to localize rupture or bursting of the integral bottom wall at specific areas, and the density and type of material of the gas seal 14. The safety feature is designed to allow an escape route for excessive pressures when the burning powder charge 26 creates excessive gas pressure, but yet maintain sufficient pressure to have the shot cup 12 and especially the ruptured parted gas seal 14 clear the barrel of the shotgun.

Various modifications can be made to the shot wad column of the present invention without departing from the apparent scope hereof.

Having thus described the invention, what is claimed is:

1. A shot wad column, comprising a shot cup having a slitted sidewall and a bottom wall closing the lower end of the cup, the sidewall traversing the bottom wall and having a lower annular flange extending downwardly therefrom, a cup-shaped gas seal concentrically aligned with the shot cup adjacent the lower end thereof and having a peripheral wall with a top edge and a transverse bottom wall with a depending gas sealing skirt on the periphery thereof, the shot cup sidewall having a longitudinally fluted outer periphery defining continuously open venting grooves extending entirely through the full length of the sidewall and flange, and the outer periphery of the shot cup sidewall tapering convergently toward the lower end of the cup, the peripheral wall of the gas seal having a diameter smaller than the sealing skirt and smaller than the cup sidewall and the top edge of the gas seal peripheral wall nesting within the annular flange of the shot cup and against the bottom wall thereof, whereby the grooves and taper of the cup sidewall and the smaller diameter and the nesting of the gas seal peripheral wall into the lower end of the cup contribute in cooperation with each other to provide continuous venting for the escape of excessive pressures behind the gas seal.

2. The wad column according to claim 1 and the annular flange of the shot cup receiving the top edge of the gas seal wall in close fitting relation.

3. The wad column according to claim 1 and the bottom wall of the shot cup having an annular groove adjacent the flange and receiving the top edge of the gas seal wall therein.

4. The wad column according to claim 1 and the bottom wall of the gas seal having means to localize bursting and rupture therethrough in response to excessive pressures behind the gas seal.

5. The wad column according to claim 1 wherein the grooves in the shot cup sidewall having a width on the same order of magnitude as the width of the annular flange.

6. The wad column according to claim 1 and the annular flange of the shot cup sidewall tapering convergently away from the bottom wall of the shot cup to cooperate with the grooves in defining castellations in the flange to continuously maintain the venting grooves in open condition.

7. A shot wad column, comprising a shot cup having an open upper end and a closed lower end and having an elongate sidewall which is longitudinally slitted through the open end thereof, a bottom wall closing the lower end of the cup and the elongate sidewall traversing the bottom wall and defining a lower annular flange extending downwardly therefrom, the elongate sidewall of the shot cup tapering convergently from the open end to the flange, and the inner periphery of the flange being tapered divergently away from the bottom wall and producing a substantially sharpened lower edge on the flange, the shot cup sidewall having a longitudinally fluted outer periphery defining continuously open venting grooves extending entirely through the full length of the sidewall and flange and defining castellations around the lower edge of the flange to maintain the venting grooves continuously open, the bottom wall of the shot cup having an annular groove adjoining the flange, and a cup-shaped gas seal concentrically aligned with the shot cup adjacent the lower end thereof and having a peripheral wall with a top edge telescopically related within the flange and being nested into the groove of the bottom wall of the shot cup, the gas seal having a transverse bottom wall with a depending gas sealing skirt on the periphery thereof, and the peripheral wall of the gas seal having a diameter significantly smaller than the gas sealing skirt and smaller than the cup sidewall.

8. The shot wad column according to claim 7 wherein the venting grooves having widths of the same order of magnitude as the width of the flange on the shot cup sidewall.

* * * * *